US012604986B2

(12) United States Patent
Muradian

(10) Patent No.: US 12,604,986 B2
(45) Date of Patent: Apr. 21, 2026

(54) CHAIR FOR FACILITATING CROSS-LEGGED SEATING

(71) Applicant: Alexander Muradian, Westhampton Beach, NY (US)

(72) Inventor: Alexander Muradian, Westhampton Beach, NY (US)

(73) Assignee: Alexander Muradian, Westhampton Beach, NY (US)

( * ) Notice: Subject to any disclaimer, the term of this patent is extended or adjusted under 35 U.S.C. 154(b) by 143 days.

(21) Appl. No.: 18/773,902

(22) Filed: Jul. 16, 2024

(65) Prior Publication Data

US 2025/0024951 A1 Jan. 23, 2025

Related U.S. Application Data

(60) Provisional application No. 63/513,945, filed on Jul. 17, 2023.

(51) Int. Cl.
*A47C 7/50* (2006.01)
*A47C 3/16* (2006.01)
*A47C 7/02* (2006.01)

(52) U.S. Cl.
CPC ..... *A47C 7/503* (2013.01); *A47C 3/16* (2013.01); *A47C 7/029* (2018.08)

(58) Field of Classification Search
CPC ..... A47C 16/04; A47C 15/004; A47C 3/16; A47C 7/029
See application file for complete search history.

(56) References Cited

U.S. PATENT DOCUMENTS 3,890,004 A * 6/1975 Rail ..... A47C 15/004 5/652
4,673,216 A * 6/1987 Alfer ..... A47C 15/004 5/653
5,029,350 A * 7/1991 Edelson ..... A47C 3/16 297/229
5,134,740 A * 8/1992 Summer ..... A47C 15/004 5/652
5,490,717 A * 2/1996 Greene ..... A47C 7/029 297/452.41
2017/0318970 A1* 11/2017 Roizner ..... A47C 15/004
2021/0282559 A1* 9/2021 Towle ..... A47C 17/04
2022/0354263 A1* 11/2022 Salazar ..... A47C 15/004

FOREIGN PATENT DOCUMENTS

JP H0730806 U * 6/1995 ..... A47C 7/029

OTHER PUBLICATIONS

Alexia Meditation Seat English, https://www.youtube.com/watch?v=TBd3Wly3aAM (Year: 2016).*

* cited by examiner

*Primary Examiner* — Eric J Kurilla

(57) ABSTRACT

A chair for facilitating cross-legged seating is disclosed. The chair includes a seat portion defining an upper surface positioned towards rear end of the chair, and a leg support portion positioned towards a front end of the chair. The leg support portion defines a base, a left sidewall, and a right sidewall. The left sidewall defines a left inclined surface configured to support a left knee region of the user, and a left chamber configured to support a right foot of the user. The right sidewall defines a right inclined surface configured to support a right knee region of the user, and a right chamber configured to support a right foot of the user.

20 Claims, 6 Drawing Sheets

CHAIR FOR FACILITATING CROSS-LEGGED SEATING

TECHNICAL FIELD

The present invention relates, generally, to a chair, and more particularly to a chair that supports cross-legged seating and enables users to maintain an upright back posture with minimal lower body strain while engaging in various activities, such as meditation.

BACKGROUND

Traditional chairs, widely used in various environments such as homes, offices, and educational institutions, often fail to provide optimal support and comfort for extended periods of sitting. Prolonged sitting in conventional chairs can lead to numerous health issues, including back pain, poor posture, and reduced circulation, ultimately impacting productivity and overall well-being.

In recent years, standing desks have gained popularity as a solution to the health concerns associated with prolonged sitting. Standing desks offer several advantages, including the promotion of an upright posture, increased energy levels, and improved circulation. However, standing desks may not always be practical or desirable in certain situations, such as during activities that require stable seating or for individuals who may find prolonged standing uncomfortable or tiring. The conventional chairs and seats cause cramping and discomfort during prolonged sitting, as they face challenges of inadequate airflow, incorrect geometries, and improper elevation, leading to discomfort, cramping, and fatigue that prevent prolonged sittng Therefore, there exists a need for a seating solution that allows users to engage in a variety of activities while promoting proper posture, reducing lower body strain, and enhancing overall comfort, thereby improving user health and productivity in diverse settings.

SUMMARY

In one aspect, a chair for facilitating cross-legged seating disclosed. The chair may include a seat portion defining an upper surface positioned towards a rear end of the chair. The upper surface may be configured to support the buttocks of a user when the user is seated in a cross-legged seating posture on the chair. The chair may further include a leg support portion positioned towards a front end of the chair. The leg support portion may define a base defined towards a bottom end of the leg support portion and extending from the seat portion towards the front end of the chair. The leg support portion may further define a left sidewall positioned towards a left end of the leg support portion and extending from the seat portion towards the front end of the chair. The left sidewall may define a left inclined surface extending from a top end of the leg support portion and laterally inclining towards the left end of the leg support portion. The left inclined surface may be configured to support a left knee region of the user. The left sidewall may further define a left chamber defined vertically below left inclined surface, and configured to support a right foot of the user. The leg support portion may further define a right sidewall positioned towards a right end of the leg support portion and extending from the seat portion towards the front end of the chair. The right sidewall may define a right inclined surface extending from the top end of the leg support portion and laterally inclining towards the right end of the leg support portion. The right inclined surface may be configured to support a right knee region of the user. The right sidewall may further define a right chamber defined vertically below right inclined surface, and may be configured to support a right foot of the user.

In another aspect, a leg support for facilitating cross-legged seating is disclosed. The leg support may include a base, a left sidewall, and a right sidewall. The base may be defined towards a bottom end of the leg support and extending from a rear end towards a front end of the leg support. The left sidewall may be positioned towards a left end of the leg support and extending from the rear end towards the front end of the leg support. The left sidewall may define a left inclined surface extending from a top end of the leg support and laterally inclining towards the left end of the leg support. The left inclined surface may be configured to support a left knee region of the user. The left sidewall may further define a left chamber defined vertically below left inclined surface, and configured to support a right foot of the user. The right sidewall may be positioned towards a right end of the leg support and extending from the rear end towards the front end of the leg support. The right sidewall may define a right inclined surface extending from the top end of the leg support and laterally inclining towards the right end of the leg support. The right inclined surface may be configured to support a right knee region of the user. The right sidewall may further define a right chamber defined vertically below right inclined surface, and configured to support a right foot of the user.

DETAILED DESCRIPTION

Figure 1:
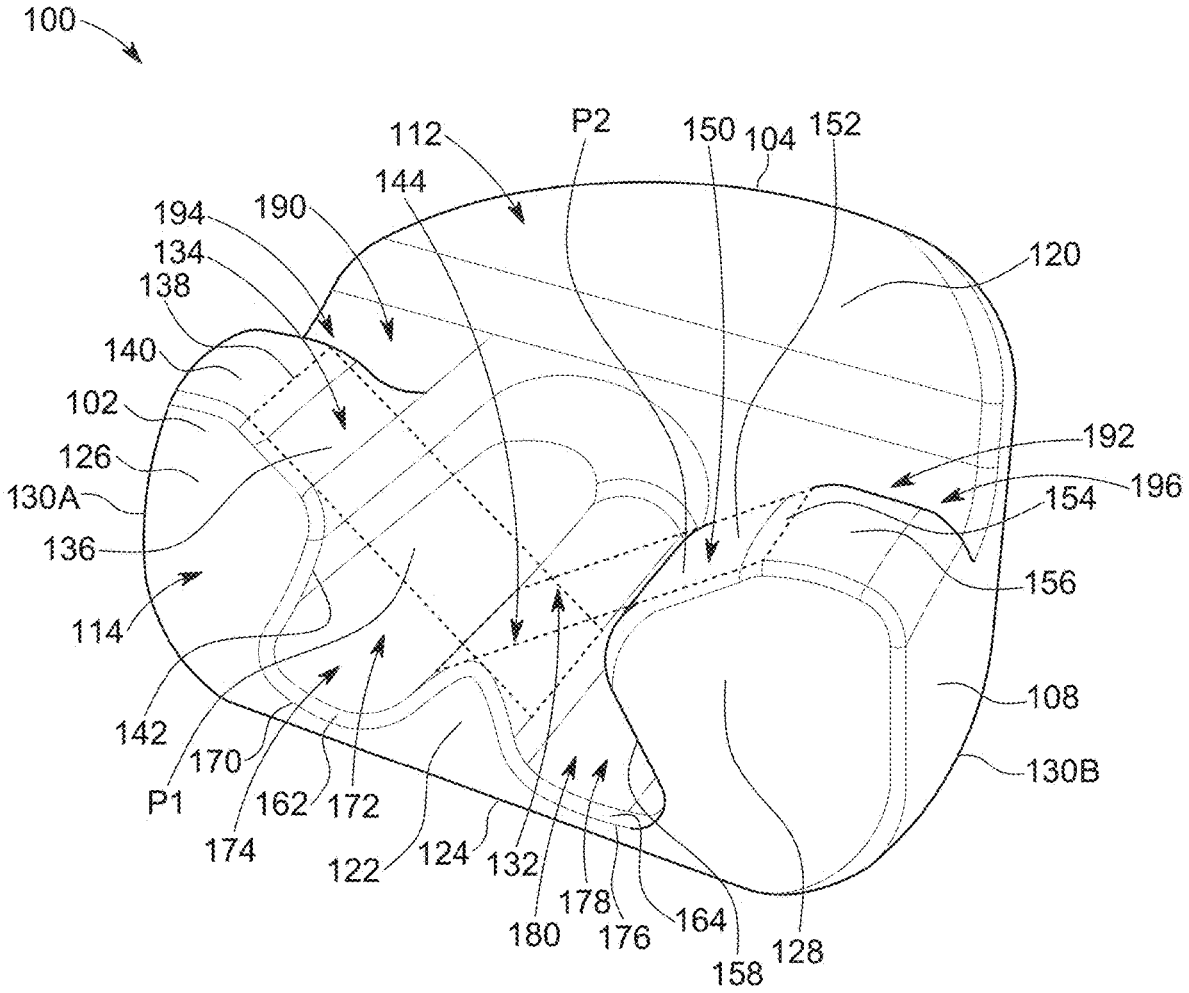
FIG. 1 illustrates a perspective view of a chair, in accordance with an embodiment of the disclosure.
Figure 2:
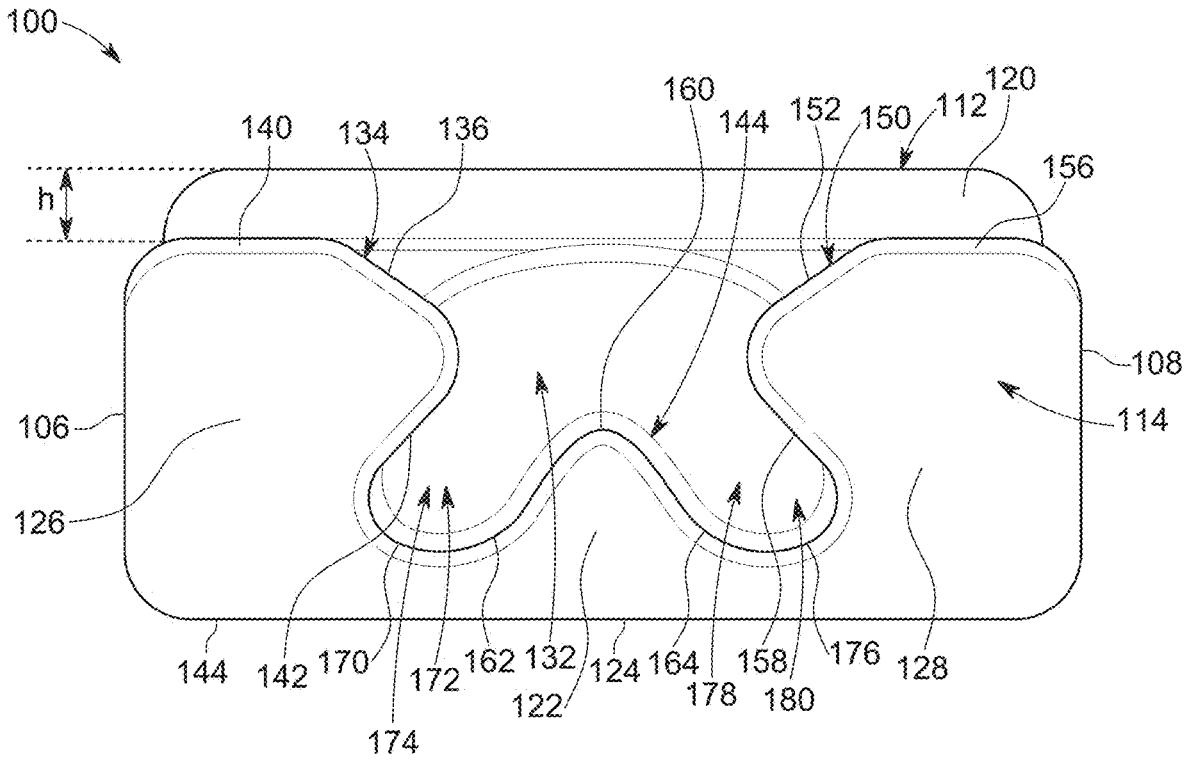
FIG. 2 illustrates a front view of the chair of FIG. 1, in accordance with an embodiment of the disclosure.
Figure 3:
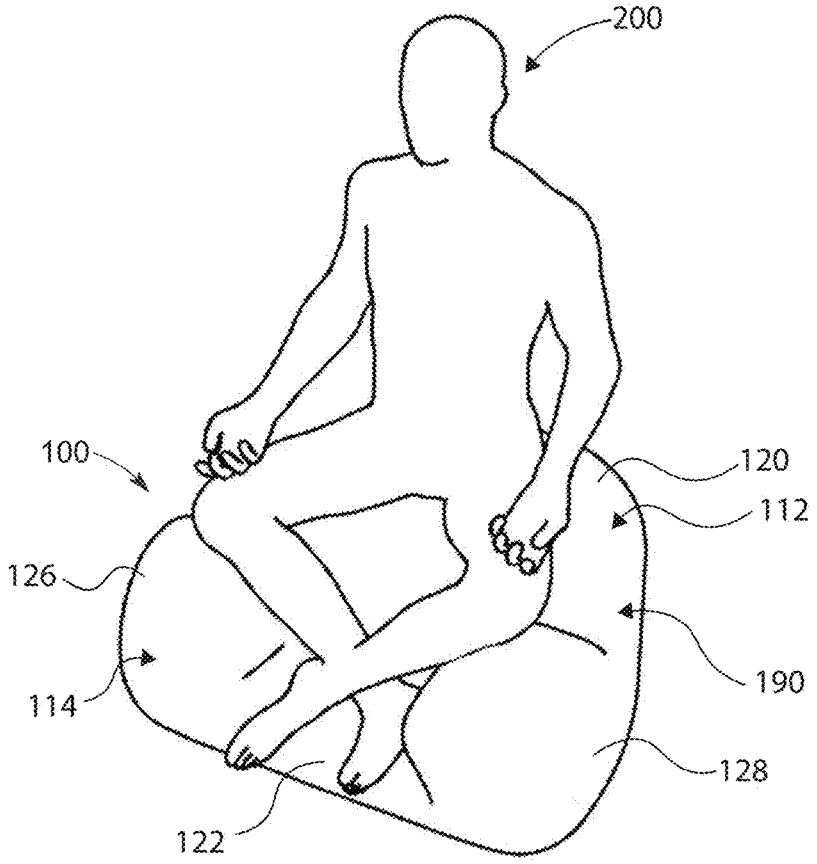
FIG. 3 illustrates a perspective view of the chair of FIG. 1 with a user seated on the chair in cross-legged posture (i.e. first orientation), in accordance with an embodiment of the disclosure.

Referring to FIGS. 1-2, a perspective view and a front view, respectively, of a chair 100 are illustrated, according to an example embodiment of the disclosure. In an embodiment, the chair 100 is entirely composed of a cushion in order to support a user optimally. Alternatively, the chair 100 may be made of wood or any other metal having pieces of the cushion at some predefined positions to support the user. When a user sits on the chair 100, the cushion compresses slightly, which alleviates the pressure on the various body parts of the user. By alleviating pressure on the user, the chair 100 provides comfort to the user and helps remove stress from the body of the user. In the embodiment illustrated in FIGS. 1-2, the cushion lining may be composed of polyurethane foam. In some embodiments, the cushion may be formed by other sponge-like material. However, it should be noted that the actual composition of the cushion is not limited to the above materials and may include any other material that is capable of accommodating the user comfortably in the chair 100. The chair 100 may be adapted to be placed on a flat floor. The chair may define a front end 102 and a rear end 104, and may extend laterally between a first lateral end 106 and a second lateral end 108.

As shown in FIGS. 1-2, the chair 100 may include a seat portion 112 and a leg support portion 114. The leg support portion 114 may be positioned towards the front of the chair 100, i.e. towards the front of the seat portion 112. In an embodiment, the leg support portion 114 may be integrated with the seat portion 112. In alternate embodiments, the leg support portion 114 may be configured as a separate module and coupled with the seat portion 112 or simply positioned forwardly of the seat portion 112. The seat portion 112 may be adapted to allow a user to sit by placing their buttocks on the seat portion 112; the leg support portion 114 may be adapted to support the legs of the user when the user is sitting on the seat portion 112 in a cross-legged posture. The seat portion 112 may extend from the rear end 104 of the chair 100 to the leg support portion 114; and the leg support portion 114 may extend from the seat portion 112 to the front end of the chair 100.

As shown in FIGS. 1-2, the seat portion 112 may define an upper surface 120 positioned towards a rear end 104 of the chair 100. The seat portion 112 may be adapted to allow the user to sit by placing their buttocks on the seat portion 112. In particular, the upper surface 120 of the seat portion 112 may be configured to support the buttocks of the user when the user is seated in a cross-legged seating posture. The upper surface 120 may define a substantially horizontal surface that provides a flat seating region for the user to sit. As such, the chair 100 may facilitate the seating of the user in the cross-legged seating posture, i.e. a first orientation, as shown in FIGS. 3-6. Further, the chair 100 may facilitate the seating of the user in a second orientation, as shown in FIGS. 7-10. In the cross-legged seating posture, the face of the user is oriented facing the front end 102 of the chair 100 with the legs of the user supported on the leg support portion 114, while in the second orientation, the face of the user is oriented opposite to the front end 102.

The leg support portion 114 may be positioned towards the front end 102 of the chair 100, i.e. towards the front of the seat portion 112. The leg support portion 114 may define a base 122 defined towards a bottom end 124 of the leg support portion 114. The base 122 may extend from the seat portion 112 towards the front end 102 of the chair 100, and longitudinally between longitudinal edges 130A, 130B. The leg support portion 114 may define a pair of sidewalls—a left sidewall 126 and a right sidewall 128, extending vertically upwardly from the base 122. The left sidewall 126 and a right sidewall 128 may be arranged spaced apart and substantially parallel to each other, and may extend upwardly from the longitudinal edges 130A, 130B of the base 122. Accordingly, a cavity 132 may be defined between the base 122 and the left sidewall 126 and a right sidewall 128 to receive the legs of the user sitting on the chair 100 in the cross-legged posture.

The left sidewall 126 may be positioned towards a left end of the leg support portion 114 and extending from the seat portion 112 towards the front end 102 of the chair. The left sidewall 126 may define a left inclined surface 136 extending from a top end of the leg support portion 114 and laterally inclining towards the left end of the leg support portion 114. In particular, the left sidewall 126 may include a first surface 134 that may be arranged facing the right sidewall 128; the first surface 134 may include the left inclined surface 136 extending obliquely and downwardly from an upper end 138 of the left sidewall 126. The left inclined surface 136 may extend outwardly from the upper end 138 towards the right sidewall 128 such that the left inclined surface 136 may define an obtuse angle with a left upper surface 140 of the left sidewall 126. The left inclined surface 136 may be configured to support a left knee region of the user. The left sidewall 126 may further define a left chamber 172 that may be defined vertically below left inclined surface 136. The left chamber 172 may be configured to support a right foot of the user.

Corresponding to the left sidewall 126, the right sidewall 128 may be positioned towards a right end of the leg support portion 114. Further, the right sidewall 128 may extend from the seat portion 112 towards the front end 102 of the chair. The right sidewall 128 may define a right inclined surface 152 extending from the top end of the leg support portion 114 and laterally inclining towards the right end of the leg support portion 114. In particular, the right sidewall 128 may include a first surface 150 that may be arranged facing the left sidewall 126; the first surface 150 may include the right inclined surface 152 extending obliquely and downwardly from an upper end 154 of the right sidewall 128. The right inclined surface 152 may extend outwardly from the upper end 154 towards the left sidewall 126 such that the right inclined surface 152 may define an obtuse angle with a right upper surface 156 of the right sidewall 128. The right inclined surface 152 may be configured to support a right knee region of the user. The right sidewall 128 may further include a right chamber 178 defined vertically below right inclined surface 152. The right chamber 178 may be configured to support a right foot of the user.

As mentioned above, the left sidewall 126 may include the left upper surface 140 extending from the seat portion 112 towards the front end 102 of the chair 100. The left upper surface 140 may be aligned horizontally and positioned adjacent to and leftwards of the left inclined surface 136. The left upper surface 140 may be adapted to further support the left knee region (of the left leg) of the user, when the user is seated in the cross-legged position. It should be noted that the left inclined surface 136 and the left upper surface 140 may form a continuous surface profile.

Similarly, the right sidewall 128 may further include a right upper surface 156 extending from the seat portion 112 towards the front end 102 of the chair. The right upper surface 156 may be aligned horizontally and positioned adjacent to and rightwards of the right inclined surface 152. The right upper surface 156 may be adapted to further support the right knee region (of the right leg) of the user, when the user is seated in the cross-legged position. The right inclined surface 152 and the right upper surface 156 may form a continuous surface profile.

In an embodiment, the left upper surface 140 and the left inclined surface 136 may define a first left obtuse angle therebetween. In other words, the left upper surface 140 and the left inclined surface 136 may be oriented with respect to each other at the first left obtuse angle. Further, the right upper surface 156 and the right inclined surface 152 may define a first right obtuse angle therebetween. In other words, the right upper surface 156 and the right inclined surface 152 may be oriented with respect to each other at the first right obtuse angle. In an embodiment, the first left obtuse angle may be equal to the first right obtuse angle. For example, in such embodiment, the left obtuse angle and the first right obtuse angle may be selected from range of 137 to 142 degrees.

As shown in FIGS. 1-2, the base 122 of the leg support portion 114 may define a central raised portion 160 that may be positioned between the left chamber 172 and the right chamber 178. As such, the base 122 may not be flat, and may include the central raised portion 160 around the middle portion of the base 122. Further, in other words, the central raised portion 160 of the base 122 may separate the left chamber 172 from the right chamber 178.

In an embodiment, the left sidewall 126 may further include a first left bottom inclined surface 142 that may extend from the seat portion 112 towards the front end 102 of the chair. The first left bottom inclined surface 142 may be defined vertically below the left inclined surface 136, and aligned substantially parallel to the right inclined surface 152. As such, the first left bottom inclined surface 142 may extend obliquely and inwardly from the left inclined surface 136 to a bottom end (i.e., the base 122) of the left sidewall 126. Further, the first left bottom inclined surface 142 may extend inwardly from the left inclined surface 136 and away from the right sidewall 128, such that the first left bottom inclined surface 142 may define an obtuse angle with the left inclined surface 136. Furthermore, the first left bottom inclined surface 142 may define an acute angle with a bottom surface 144 of the base 122.

For example, the obtuse angle between the left bottom inclined surface 142 and the left inclined surface 136 may be selected from a range of 60 and 120 degrees. The acute angle between the left bottom inclined surface 142 and the bottom surface 144 may be selected from a range of 8 and 55 degrees.

The left sidewall 126 may further include a second left bottom inclined surface 162 extending from the seat portion 112 towards the front end 102 of the chair. The second left bottom inclined surface 162 may extend from the left sidewall 126 towards the central raised portion 160. In other words, the second left bottom inclined surface 162 may extend from the central raised portion 160 and may be positioned facing the first left bottom inclined surface 142. As such, the second left bottom inclined surface 162 may be disposed at an inclination relative to the central raised portion 160 and extends downwardly of the central raised portion 160.

The left sidewall 126 may further include a left fillet 170 that may be defined at an interface of the first left bottom inclined surface 142 and the second left bottom inclined surface 162. As such, the first left bottom inclined surface 142, the second left bottom inclined surface 162, and the left fillet 170 may together form a continuous surface. Further, the first left bottom inclined surface 142, the second left bottom inclined surface 162, and the left fillet 170 may together define the left chamber 172. The left chamber 172 may be configured to receive a foot, for example, right foot of the user sitting on the chair 100 in the cross-legged posture, and hence defines a first foot support portion 174.

In an embodiment, corresponding to the left sidewall 126, the right sidewall 128 may include a first right bottom inclined surface 158 extending from the seat portion 112 towards the front end 102 of the chair. The first right bottom inclined surface 158 may be defined vertically below the right inclined surface 152, and aligned substantially parallel to the left inclined surface 136. As such, the first right bottom inclined surface 158 may extend obliquely and inwardly from the right inclined surface 152 to a bottom end (i.e., the base 122) of the right sidewall 128. Further, the first right bottom inclined surface 158 may extend inwardly from the right inclined surface 152 and away from the left sidewall 126, such that the right bottom inclined surface 158 may define an obtuse angle with the right inclined surface 152. Furthermore, the right bottom inclined surface 158 may define an acute angle with the bottom surface 144 of the base 122.

In an embodiment, the obtuse angle between the right bottom inclined surface 158 and the right inclined surface 152 may be equal to the obtuse angle between the first left bottom inclined surface 142 and the left inclined surface 136. Further, the acute angle between the right bottom inclined surface 158 and the bottom surface 144 may be equal to the acute angle between the first left bottom inclined surface 142 and the bottom surface 144. As such, for example, the obtuse angle between the right bottom inclined surface 158 and the right inclined surface 152 may be selected from a range of 60 and 120 degrees. The acute angle between the right bottom inclined surface 158 and the bottom surface 144 may be selected from a range of 8 and 55 degrees.

The right sidewall 128 may further include a second right bottom inclined surface 164 extending from the seat portion 112 towards the front end 102 of the chair. The second right bottom inclined surface 164 may extend from the left sidewall 126 towards the central raised portion 160. In other words, second right bottom inclined surface 164 may extend from the central raised portion 160 and positioned facing the left right inclined surface 152. As such, the second right bottom inclined surface 164 may be disposed at an inclination relative to the central raised portion 160 and extends downwardly of the central raised portion 160.

Further, the right sidewall 128 may include a right fillet 176 defined at an interface of the first right bottom inclined surface 158 and the second right bottom inclined surface 164. Therefore, the right left bottom inclined surface 158, the second right bottom inclined surface 164, and the right fillet 176 together define a continuous surface. Further, the right left bottom inclined surface 158, the second right bottom inclined surface 164, and the right fillet 176 may together define the right chamber 178. The right chamber 178 may be configured to receive a foot, for example, left foot of the user sitting on the chair 100 in the cross-legged posture, and hence defines a second foot support portion 180.

In an embodiment, each of the left fillet 170 and the right fillet 176 may be configured in a circular profile. For example, each of the left fillet 170 and the right fillet 176 may define a circular profile of a radius of roughly 0.75 inches.

It should be noted that, in the cross-legged seating posture, the user may sit on the chair 100 such that the legs are arranged in cross configuration with the left foot of the user is positioned within the left chamber 172 and the right foot of the user is positioned within the right chamber 178.

Further, in the cross-legged seating posture, the left knee/calf region may be supported by the right inclined surface 152 of the right sidewall 128, while the right knee/calf region may be supported by the left inclined surface 136 of the left sidewall 126.

As shown in FIGS. 1-2, the left inclined surface 136 and the second right bottom inclined surface 164 may be coplanar along a first plane P1. In other words, each of the left inclined surface 136 and the second right bottom inclined surface 164 may define substantially planar surfaces, such that the substantially planar surfaces are coplanar along the first plane P1, at least when the user is not seated on the chair 100 and the shape of the chair 100 is not deformed due to the cushioning effect in response to the weight of the user. Further, the right inclined surface 152 and the second left bottom inclined surface 162 may be coplanar along a second plane P2. As such, each of the right inclined surface 152 and the second left bottom inclined surface 162 may define substantially planar surfaces, such that the substantially planar surfaces are coplanar along the second plane P2, at least when the user is not seated on the chair 100. In an example embodiment, the first plane P1 and the second plane P2 may be aligned to each other at an angle selected from a range of 45° to 55°. In an alternate example embodiment, the first plane P1 and the second plane P2 may be aligned to each other at an angle selected from a range of 48° to 52°.

As shown in FIGS. 1-2, in an embodiment, the first left bottom inclined surface 142 and the left inclined surface 136 define a second left obtuse angle therebetween. Correspondingly, the first right bottom inclined surface 158 and the right inclined surface 152 may define a second right obtuse angle therebetween. In an embodiment, the second left obtuse angle between the first left bottom inclined surface 142 and the left inclined surface 136 may be equal to the second right obtuse angle between the first right bottom inclined surface 158 and the right inclined surface 152. For example, the second left obtuse angle and the second right obtuse angle may be selected from a range of 60-120 degrees.

In an embodiment, as can be seen in FIG. 2, the upper surface 120 of the seat portion 112 may be positioned at a higher elevation relative to the left upper surface 140 and the right upper surface 156. Due to this, in the cross-legged sitting posture, the user's legs are positioned at a lower elevation relative to the elevation of buttocks, that allows for a comfortable sitting posture. In an example embodiment, the upper surface 120 of the seat portion 112 may be positioned at the higher elevation relative to the left upper surface 140 and the right upper surface 156 by a predefined height 'h' selected from a range of 4 centimeters (cms) to 8 cms.

Figure 6:
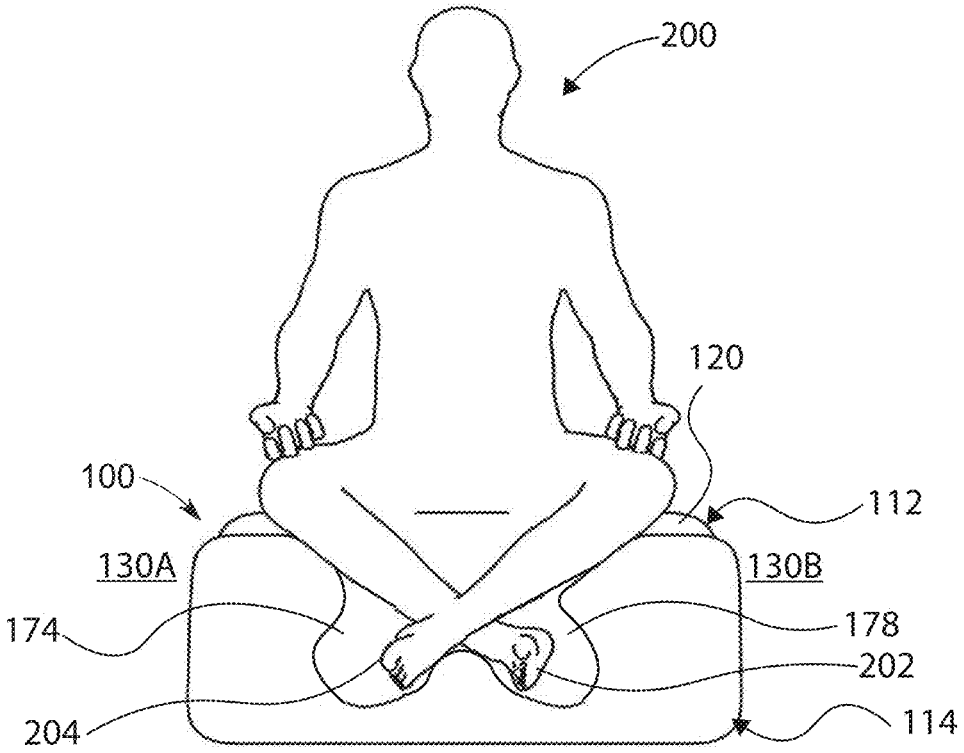
FIG. 6 illustrates a front view of the chair of FIG. 1 with the user seated on the chair in cross-legged posture (i.e. first orientation), in accordance with an embodiment of the disclosure.
Figure 7:
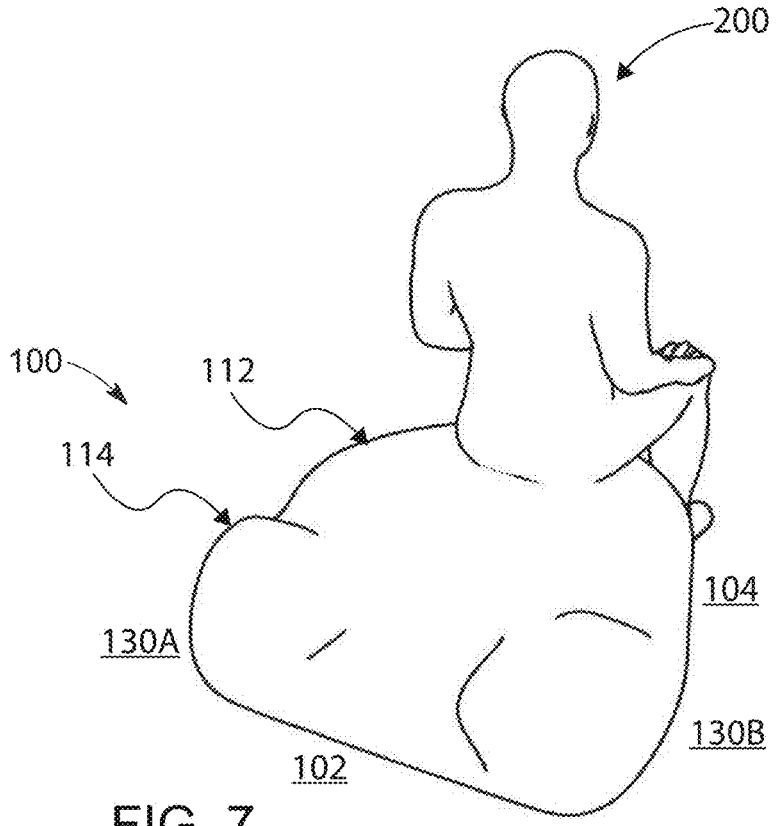
FIG. 7 illustrates a perspective view of the chair of FIG. 1 with the user seated on the chair in the second orientation, in accordance with an embodiment of the disclosure.

As shown in FIG. 1, a chair 100 may define a left depression 190 at an interface of the left sidewall 126 and the seat portion 112. The left depression 190 may run laterally to define a left channel 194. Further, the chair 100 may define a right depression 192 at an interface of the right sidewall 128 with the seat portion 112. The right depression 192 may run laterally to define a right channel 196. The left channel 194 and the right channel 196 may promote passage of air through the depressions 190, 192 and underneath thighs of the user, to prevent a cramped sensation Referring now to FIGS. 3-6, various views of the chair 100 with a user 200 seated on the chair 100 in cross-legged posture (i.e. first orientation) are illustrated, in accordance with some embodiments. In particular, FIGS. 3-6 illustrate a perspective view, a right-side view, a top view, and a front view, respectively, of the chair 100 with the user 200 seated on the chair 100 in cross-legged posture (i.e. first orientation). As shown in FIGS. 3-6, when seated in the cross-legged posture, the face of the user 200 is oriented facing the front end 102 of the chair 100 with the legs of the user 200 supported on the leg support portion 114. Further, the buttocks of the user 200 are supported on the upper surface 120 of the seat portion 112. As shown in FIG. 6, when seated in the cross-legged posture, a right foot 204 of the user 200 is received in the left chamber 172, and a left foot 202 of the user 200 is received in the right chamber 178.

Figure 4:
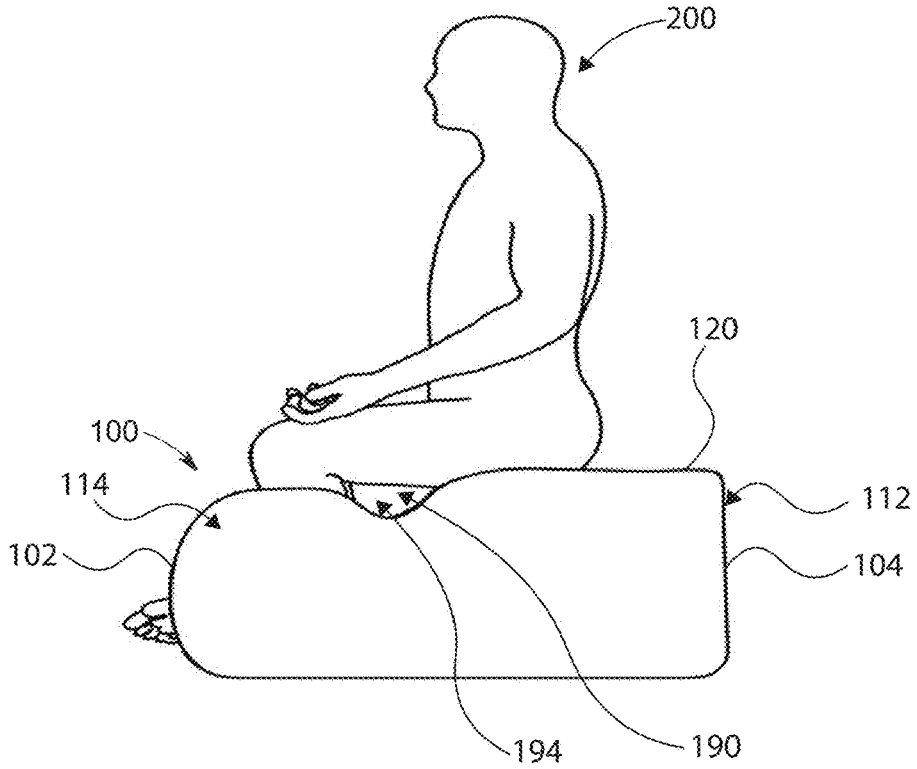
FIG. 4 illustrates a perspective right-side view of the chair of FIG. 1 with the user seated on the chair in cross-legged posture (i.e. first orientation), in accordance with an embodiment of the disclosure.
Figure 5:
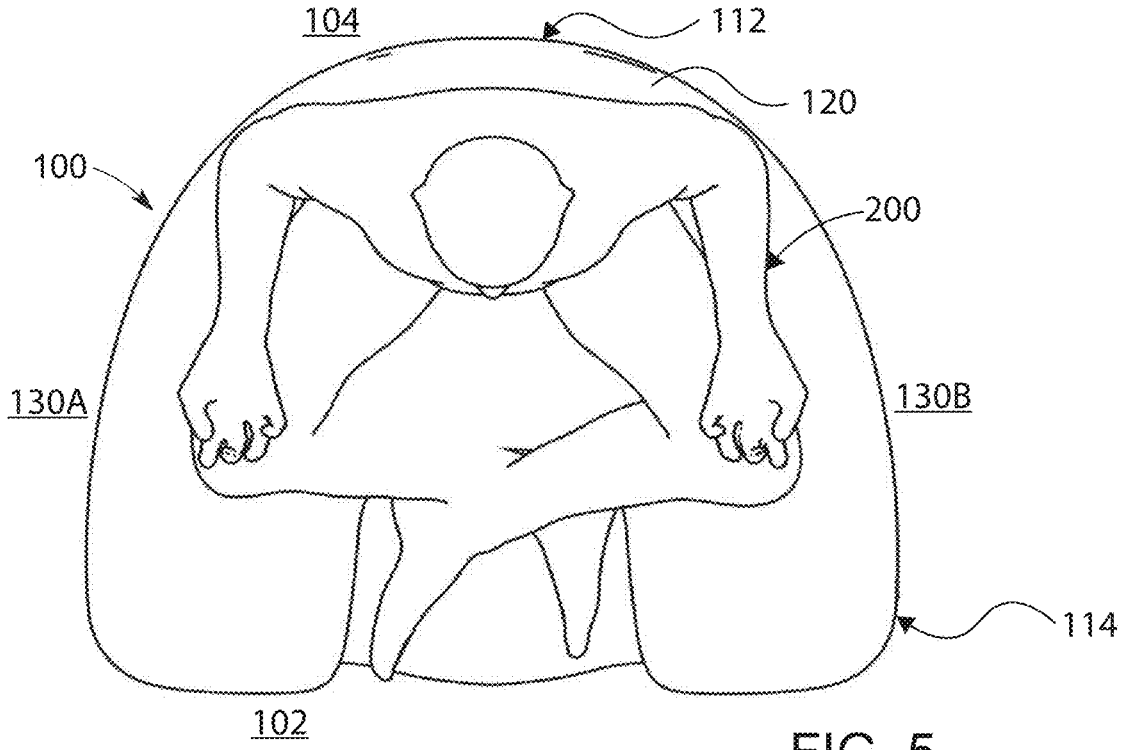
FIG. 5 illustrates a top view of the chair of FIG. 1 with the user seated on the chair in cross-legged posture (i.e. first orientation), in accordance with an embodiment of the disclosure.

Further, as shown in FIG. 4, the chair 100 defines the left depression 190 that may run laterally to define the left channel 194. Similarly, the chair 100 defines the right depression 192 that may run laterally to define the right channel 196 (not visible in FIG. 4). The left channel 194 and the right channel 196 may promote passage of air through the depressions 190, 192 and underneath thighs of the user, to prevent a cramped sensation Referring now to FIGS. 7-10, various views of the chair 100 with a user 200 seated on the chair 100 in the second orientation are illustrated, in accordance with some embodiments. In particular, FIGS. 7-10 illustrate a perspective view, a right-side view, a top view, and a front view, respectively, of the chair 100 with the user 200 seated on the chair 100 in the second orientation. As shown in FIGS. 7-10, when seated in the second orientation, the face of the user is oriented opposite to the front end 102.

Figure 8:
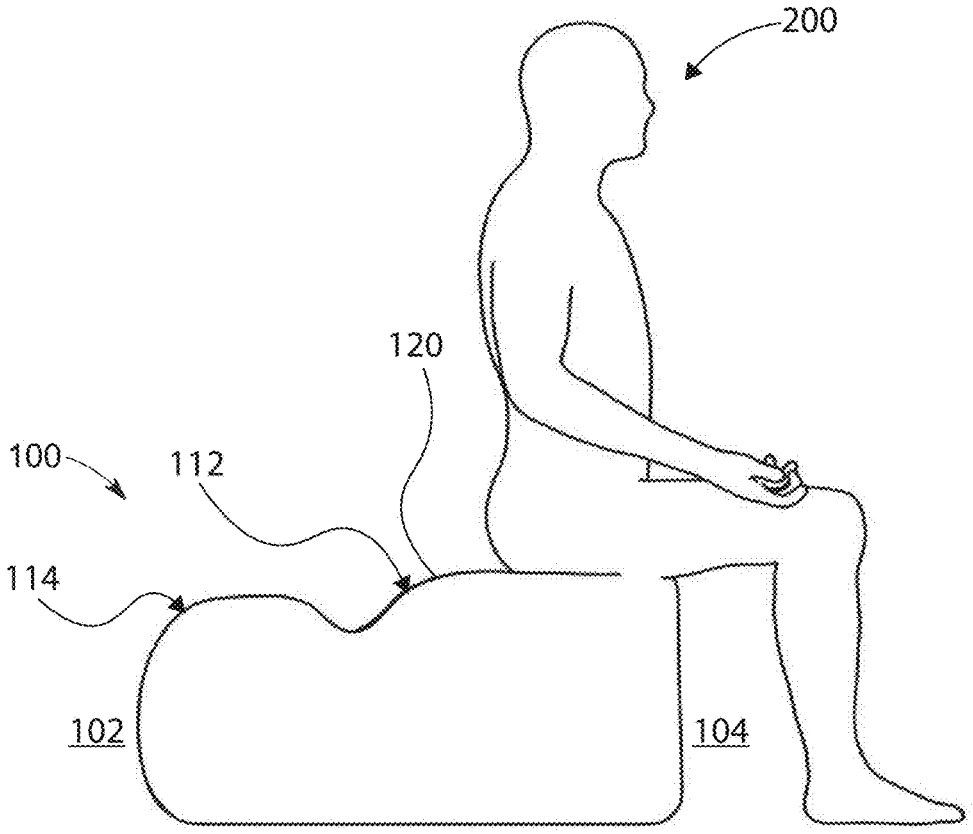
FIG. 8 illustrates a right-side view of the chair of FIG. 1 with the user seated on the chair in the second orientation, in accordance with an embodiment of the disclosure.
Figure 9:
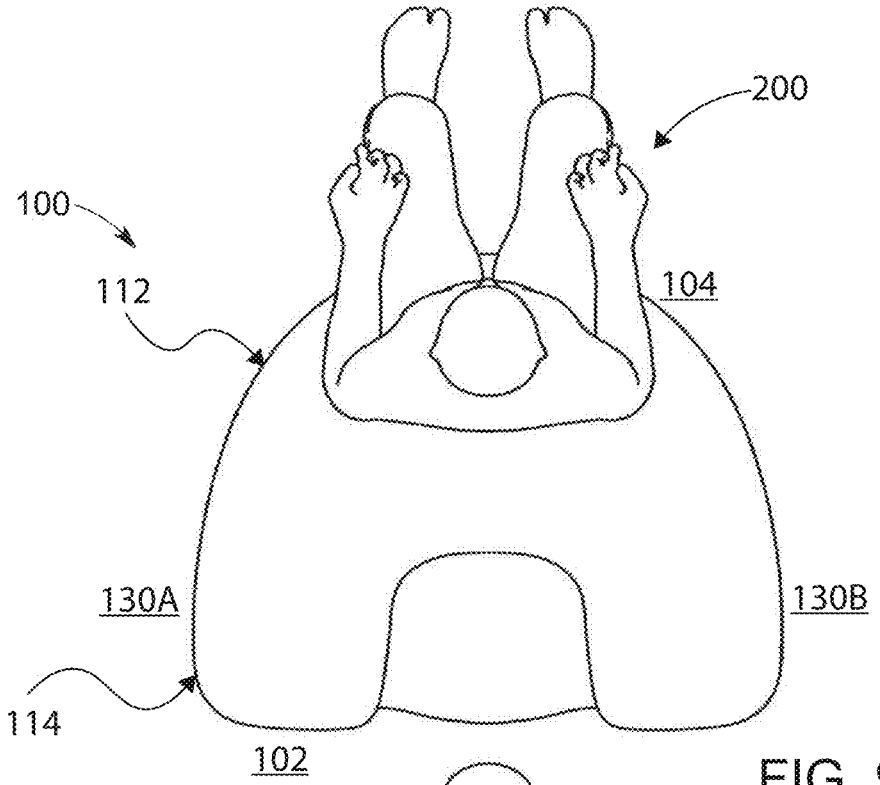
FIG. 9 illustrates a top view of the chair of FIG. 1 with the user seated on the chair in the second orientation, in accordance with an embodiment of the disclosure.
Figure 10:
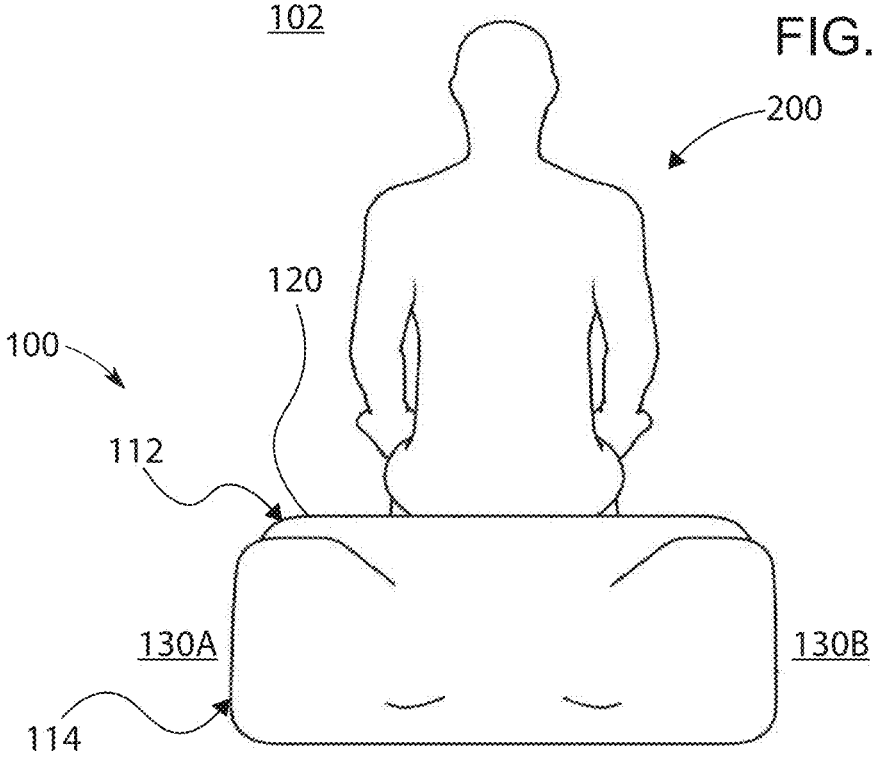
FIG. 10 illustrates a front view of the chair of FIG. 1 with the user seated on the chair in the second orientation, in accordance with an embodiment of the disclosure.

As shown in FIG. 8, in the second orientation, the user 200 may sit off the back of the chair 100 on the seat portion 112 with their feet on the floor, forming a 90-degree angle at the hips and a 90-degree angle at the knees relative to the floor. This configuration promotes optimal ergonomic alignment and comfort for the user 200.

In some embodiments, the leg support portion 114 may be configured as a separate module and coupled with the seat portion 112 or simply positioned forwardly of the seat portion 112. In other words, in such embodiments, the seat portion 112 and the leg support portion 114 may be provided as separate independent modules. Further, it may be noted that the leg support portion 114, as described above, may be used in conjunction with any seat similar to the seat portion 112, to achieve the above functionalities.

It should be further noted that the chair 100 may be adaptable with the use of one or more accessory pillows. The one or more accessory pillows may be strategically positioned to accommodate a wide range of postures and individual preferences of the user. This flexibility ensures that the chair 100 can be customized to provide optimal support and comfort for various seating positions and user needs.

The above disclosure provides for the chair 100 that enables long-term ergonomic backless seating, without causing cramping or stressing the joints or muscles. Further, the chair 100 facilitates siting of the user in at least two different orientations or sitting of one or more users on the upper surface 120 of the seat portion 112 simultaneously. As described above, the at least two different orientations include the cross-legged posture, i.e., the first orientation, facing towards the front of the chair 100 and the second orientation, facing backwards with their feet on the ground. The chair 100 can be used at a standard desk as a work chair, allowing users (e.g. (office workers) to work while maintaining correct posture and engaged back muscles. The chair also facilitates rotation of ankles in the cross configuration which also prevents back pain and other musculoskeletal problems that may arise from prolonged sitting in a traditional office chair. Therefore, the chair 100 prevents discomfort, cramping, and stress caused by long-term sitting in conventional chairs, by promoting correct posture, engaging the lower back muscles, and preventing joint and muscle strain, thereby making it an ideal solution for users who spend significant time sitting. The chair 100 provides a multifunctional solution that allows it to be used in multiple different seated geometries without a back—this versatility provides users with the ability to adopt various seating positions, thereby enhancing comfort and functionality. Additionally, the chair provides for an elevated cross-legged position, which promotes airflow underneath the thighs to prevent a cramped sensation.

Unlike conventional cushions and seats that may force the hips to internally rotate or create pushing and pulling forces on the legs, the above chair encourages external rotation of the hips, thereby ensuring proper alignment of the hips, spine, neck, and head. As a result, the chair provides for a comfortable sitting experience that can be sustained over long periods of time, without the pain and discomfort that accompanies extended periods of sitting.

The chair provides for stacks the head, shoulders, and hips, thereby allowing for stable, natural upper-back extension and head alignment. Further, the chair supports the core without pulling and pushing forces on the sacrum and lower back by taking advantage of external hip rotation stabilizing forces on the trunk. By incorporating a gap under the thigh and creating one point of contact on the shin and ankle, the chair allows for freedom of movement and airflow while preventing a cramped sensation. Further, the knees are positioned below the hips to allow the hips to externally rotate, so the lumbar spine keeps its natural optimal curve. Furthermore, the chair provides SITZ bones a soft, but firm base of support, preventing a sagging pelvis that can cause stress and pain over time. As such, the chair is optimized for meditation—either sitting cross legged or backless with feet on the floor. Moreover, the shape and size of the chair allows the user to explore other archetypal postures, thereby making it an optimal choice for users with reduced flexibility in their hips where traditional seating or sitting on the floor is simply not possible.

It is intended that the disclosure and examples be considered as exemplary only, with a true scope and spirit of disclosed embodiments being indicated by the following claims.

What is claimed is:

1. A chair for facilitating cross-legged seating, the chair comprising:

a seat portion defining an upper surface positioned towards a rear end of the chair, wherein the upper surface is configured to support buttocks of a user when the user is seated in a cross-legged seating posture on the chair; and a leg support portion positioned towards a front end of the chair, the leg support portion defining:

a base defined towards a bottom end of the leg support portion and extending from the seat portion towards the front end of the chair;

a left sidewall positioned towards a left end of the leg support portion and extending from the seat portion towards the front end of the chair, the left sidewall defining:

a left inclined surface extending from a top end of the leg support portion and laterally inclining towards the left end of the leg support portion, wherein the left inclined surface is configured to support a left knee region of the user; and a left chamber defined vertically below left inclined surface, and configured to support a right foot of the user;

a right sidewall positioned towards a right end of the leg support portion and extending from the seat portion towards the front end of the chair, the right sidewall defining:

a right inclined surface extending from the top end of the leg support portion and laterally inclining towards the right end of the leg support portion, wherein the right inclined surface is configured to support a right knee region of the user; and a right chamber defined vertically below the right inclined surface, and is configured to support a right foot of the user;

wherein the left sidewall further comprises a left upper surface extending from the seat portion towards the front end of the chair, the left upper surface being aligned horizontally and positioned adjacent to and leftwards of the left inclined surface; and wherein the right sidewall further comprises a right upper surface extending from the seat portion towards the front end of the chair, the right upper surface being aligned horizontally and positioned adjacent to and rightwards of the right inclined surface.

2. The chair of claim 1, wherein the left upper surface and the left inclined surface define a first left obtuse angle therebetween, and wherein the right upper surface and the right inclined surface define a first right obtuse angle therebetween.

3. The chair of claim 2, wherein the first left obtuse angle is equal to the first right obtuse angle.

4. The chair of claim 1, wherein the base of the leg support portion defines a central raised portion positioned between the left chamber and the right chamber.

5. The chair of claim 4, wherein the left sidewall further comprises:

a first left bottom inclined surface extending from the seat portion towards the front end of the chair, the first left bottom inclined surface defined vertically below the left inclined surface, and aligned substantially parallel to the right inclined surface;

a second left bottom inclined surface extending from the seat portion towards the front end of the chair, the second left bottom inclined surface extending from the central raised portion and positioned facing the first left bottom inclined surface; and a left fillet defined at an interface of the first left bottom inclined surface and the second left bottom inclined surface;

wherein the first left bottom inclined surface, the second left bottom inclined surface, and the left fillet together define the left chamber, wherein the right sidewall further comprises:

a first right bottom inclined surface extending from the seat portion towards the front end of the chair, the first right bottom inclined surface defined vertically below the right inclined surface, and aligned substantially parallel to the left inclined surface;

a second right bottom inclined surface extending from the seat portion towards the front end of the chair, the second right bottom inclined surface extending from the central raised portion and positioned facing the left right bottom inclined surface; and a right fillet defined at an interface of the first right bottom inclined surface and the second right bottom inclined surface, wherein the right left bottom inclined surface, the second right bottom inclined surface, and the right fillet together define the right chamber.

6. The chair of claim 5, wherein each of the left fillet and the right fillet is configured in a circular profile.

7. The chair of claim 5, wherein the left inclined surface and the second right bottom inclined surface are coplanar along a first plane P1, and wherein the right inclined surface and the second left bottom inclined surface are coplanar along a second plane P2.

8. The chair of claim 7, wherein the first plane P1 and the second plane P2 are aligned to each other at an angle selected from a range of 45° to 55°.

9. The chair of claim 5, wherein the first left bottom inclined surface and the left inclined surface define a second left obtuse angle therebetween, and wherein the first right bottom inclined surface and the right inclined surface define a second right obtuse angle therebetween.

10. The chair of claim 1, wherein the upper surface of the seat portion is positioned at a higher elevation relative to the left upper surface and the right upper surface.

11. The chair of claim 10, wherein the upper surface of the seat portion is positioned at the higher elevation relative to the left upper surface and the right upper surface by a predefined height selected from a range of 4 centimeters (cm) to 8 cm.

12. The chair of claim 1, wherein a left depression is defined at an interface of the left sidewall and the seat portion, wherein a right depression is defined at an interface of the second sidewall with the seat portion, and wherein the left depression and the right depression run laterally to define a left channel and a right channel, respectively, to allow passage of air through the depressions, and underneath thighs of the user.

13. The chair of claim 1 further comprising a cushion lining, wherein the cushion lining is of polyurethane foam.

14. A leg support for facilitating cross-legged seating, the leg support comprising:

a base defined towards a bottom end of the leg support and extending from a rear end towards a front end of the leg support;

a left sidewall positioned towards a left end of the leg support and extending from the rear end towards the front end of the leg support, the left sidewall defining:

a left inclined surface extending from a top end of the leg support and laterally inclining towards the left end of the leg support, wherein the left inclined surface is configured to support a left knee region of the user; and a left chamber defined vertically below left inclined surface, and configured to support a right foot of the user;

a right sidewall positioned towards a right end of the leg support and extending from the rear end towards the front end of the leg support, the right sidewall defining:

a right inclined surface extending from the top end of the leg support and laterally inclining towards the right end of the leg support, wherein the right inclined surface is configured to support a right knee region of the user; and a right chamber defined vertically below right inclined surface, and configured to support a right foot of the user;

wherein the left sidewall further comprises a left upper surface extending from the rear end towards the front end of the leg support, the left upper surface being aligned horizontally and positioned adjacent to and leftwards of the left inclined surface; and wherein the right sidewall further comprises a right upper surface extending from the rear end towards the front end of the leg support, the right upper surface being aligned horizontally and positioned adjacent to and rightwards of the right inclined surface.

15. The leg support of claim 14, wherein the left upper surface and the left inclined surface define a first left obtuse angle therebetween, and wherein the right upper surface and the right inclined surface define a first right obtuse angle therebetween.

16. The leg support of claim 14, wherein the base of the leg support defines a central raised portion positioned between the left chamber and the right chamber.

17. The leg support of claim 16, wherein the left sidewall further comprises:

a first left bottom inclined surface extending from the from the rear end towards the front end of the leg support, the first left bottom inclined surface defined vertically below the left inclined surface, and aligned substantially parallel to the right inclined surface;

a second left bottom inclined surface extending from the rear end towards the front end of the leg support, the second left bottom inclined surface extending from the central raised portion and positioned facing the first left bottom inclined surface; and a left fillet defined at an interface of the first left bottom inclined surface and the second left bottom inclined surface;

wherein the first left bottom inclined surface, the second left bottom inclined surface, and the left fillet together define the left chamber, wherein the right sidewall further comprises:

a first right bottom inclined surface extending from the rear end towards the front end of the leg support, the first right bottom inclined surface defined vertically below the right inclined surface, and aligned substantially parallel to the left inclined surface;

a second right bottom inclined surface extending from the rear end towards the front end of the leg support, the second right bottom inclined surface extending from the central raised portion and positioned facing the left right bottom inclined surface; and a right fillet defined at an interface of the first right bottom inclined surface and the second right bottom inclined surface, wherein the right left bottom inclined surface, the second right bottom inclined surface, and the right fillet together define the right chamber.

18. The leg support of claim 17, wherein each of the left fillet and the first fillet is configured in a circular profile.

19. The leg support of claim 17, wherein the left inclined surface and the second right bottom inclined surface are coplanar along a first plane P1, and wherein the right inclined surface and the second left bottom inclined surface are coplanar along a second plane P2, wherein the first plane P1 and the second plane P2 are aligned to each other at an angle selected from a range of 45° to 55°.

20. The leg support of claim 17, wherein the first left bottom inclined surface and the left inclined surface define a second left obtuse angle therebetween, and wherein the first right bottom inclined surface and the right inclined surface define a second right obtuse angle therebetween.

* * * * *